US011821269B1

(12) United States Patent
Oettli

(10) Patent No.: US 11,821,269 B1
(45) Date of Patent: Nov. 21, 2023

(54) SWIVEL SYSTEM FOR DOWNHOLE WELL TOOL ORIENTATION

(71) Applicant: Schlumberger Technology Corporation, Sugar Land, TX (US)

(72) Inventor: Mark Callister Oettli, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/661,801

(22) Filed: May 3, 2022

(51) Int. Cl.
*E21B 17/05* (2006.01)
*E21B 17/042* (2006.01)
*E21B 17/02* (2006.01)

(52) U.S. Cl.
CPC ..... *E21B 17/05* (2013.01); *E21B 17/0285* (2020.05); *E21B 17/042* (2013.01)

(58) Field of Classification Search
CPC ..... E21B 17/02; E21B 17/021; E21B 17/028; E21B 17/0283; E21B 17/0285; E21B 17/041; E21B 17/042; E21B 17/05
See application file for complete search history.

(56) References Cited

U.S. PATENT DOCUMENTS 3,136,367 A * 6/1964 Wright ..... E21B 17/06 285/330
4,100,976 A * 7/1978 Stone ..... E21B 4/14 60/411
4,278,942 A * 7/1981 Bonnet ..... G01V 3/20 324/366
5,468,153 A 11/1995 Brown et al.
5,823,257 A 10/1998 Peyton
6,032,958 A * 3/2000 Fowler ..... E21B 33/03 277/606
6,241,032 B1 * 6/2001 Falgout, Sr. ..... E21B 21/10 192/30 W
6,244,345 B1 * 6/2001 Helms ..... E21B 7/067 166/301
6,899,174 B2 * 5/2005 Maxwell ..... E21B 47/01 166/242.7

(Continued)

OTHER PUBLICATIONS

McMaster-Carr, Zinc-Plated Steel Hose Fitting for Hydraulic Fluid, Straight Adapter, 1/2 NPSM Female x 1/2 NPTF Male, retreived from https://www.mcmaster.com/5340K48/, 2021, 2 pages.

(Continued)

*Primary Examiner* — Kipp C Wallace
(74) *Attorney, Agent, or Firm* — Jeffrey D. Frantz

(57) ABSTRACT

Systems and methods presented herein include a downhole well tool having an electromechanical joint configured to connect to a downhole well tool component within a wellbore of an oil and gas well system. The electromechanical joint is configured to rotate to facilitate connection of the electromechanical joint to the downhole well tool component. For example, the electromechanical joint includes a main body portion, a rotating ring configured to rotate relative to the main body portion to facilitate connection of the electromechanical joint to the downhole well tool component, and a sealed electrical connection configured to couple with a mating electrical connection of the downhole well tool component.

16 Claims, 7 Drawing Sheets

(56) References Cited

U.S. PATENT DOCUMENTS

| | | | | |
|---|---|---|---|---|
| 7,178,611 | B2 * | 2/2007 | Zupanick | E21B 7/067 175/107 |
| 10,036,228 | B2 * | 7/2018 | Coronado | E21B 33/16 |
| 10,844,668 | B2 * | 11/2020 | Gonzalez | H01R 13/005 |
| 2003/0075321 | A1 * | 4/2003 | Hall | E21B 47/024 166/241.1 |
| 2013/0008669 | A1 * | 1/2013 | Deere | E21B 47/00 166/65.1 |
| 2015/0308249 | A1 * | 10/2015 | Delchambre | E21B 17/042 166/65.1 |
| 2016/0201401 | A1 | 7/2016 | Craik | |
| 2018/0175545 | A1 | 6/2018 | Engel et al. | |
| 2019/0085644 | A1 * | 3/2019 | Ames | E21B 17/028 |
| 2021/0013687 | A1 | 1/2021 | Lau et al. | |

OTHER PUBLICATIONS

McMaster-Carr, Pipe Unions, retrieved from https://www.mcmaster.com/pipe-unions/type~rotating-joint/, 2022, 2 pages.

International Search Report and Written Opinion issued in International Patent application PCT/US2023/020777 dated Aug. 25, 2023, 9 pages.

* cited by examiner

SWIVEL SYSTEM FOR DOWNHOLE WELL TOOL ORIENTATION

BACKGROUND

The subject matter disclosed herein relates to systems and methods for enabling rotate of an adapter of a downhole well tool to enable the downhole well tool to couple to a downhole well tool component both mechanically and electrically.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Certain downhole well tools often need to connect to other downhole well tool components. In such situations, adapters are often used to connect to the other downhole well tool components. Certain adapters and downhole well tool components to which they connect include mono conductor connections, which means that there is only a single radial alignment of the adapter with respect to the downhole well tool component that enables electrical and mechanical coupling of the adapter to the downhole well tool component. In such situations, a cable conveying the downhole well tool having the adapter may need to twist to enable the adapter to couple to the downhole well tool component. However, certain cables are not capable of twisting quite as much as others. For example, coupling of certain adapters to downhole well tool components may be relatively easily achieved when a wireline cable is used, but it may be relatively difficult to enable enough twisting when coiled tubing is used, due at least in part to the relatively high level of torsional stiffness of the coiled tubing.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a downhole well tool adapter includes an electromechanical joint configured to connect to a downhole well tool component within a wellbore of an oil and gas well system. The electromechanical joint is configured to rotate to facilitate connection of the electromechanical joint to the downhole well tool component.

In another embodiment, an electromechanical joint includes a main body portion. The electromechanical joint also includes a rotating ring configured to rotate relative to the main body portion to facilitate connection of the electromechanical joint to a downhole well tool component within a wellbore of an oil and gas well system. The electromechanical joint further includes a sealed electrical connection configured to couple with a mating electrical connection of the downhole well tool component.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
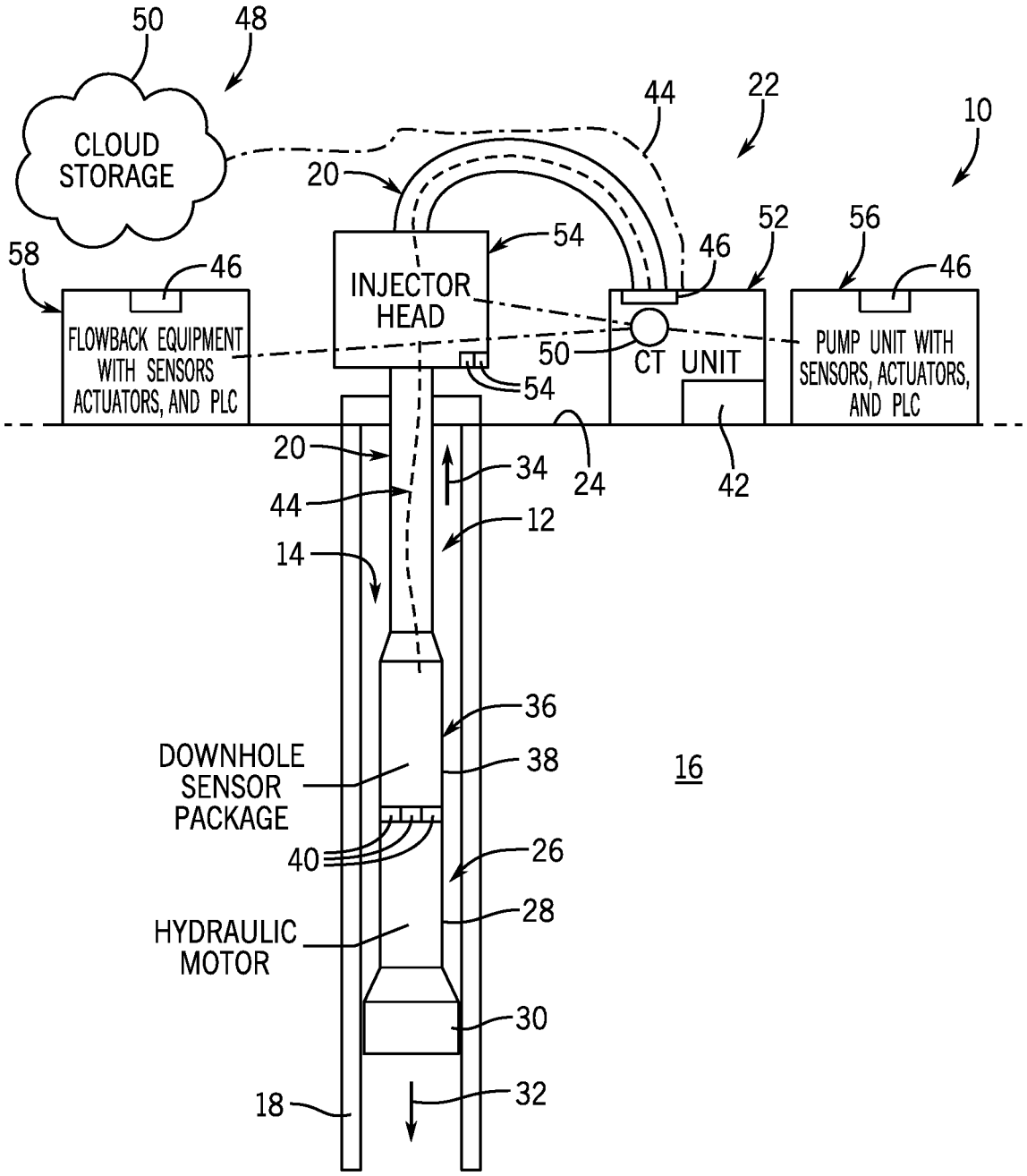
FIG. 1 is a schematic illustration of an oil and gas well system, in accordance with embodiments of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

In addition, as used herein, the terms "automatic" and "automated" are intended to describe operations that are caused to be performed, for example, by an automation control system (i.e., solely by the automation control system, without human intervention).

The embodiments described herein relate to a downhole well tool having an electromechanical joint configured to connect to a downhole well tool component within a wellbore of an oil and gas well system. The electromechanical joint is configured to rotate to facilitate connection of the electromechanical joint to the downhole well tool component. For example, the electromechanical joint includes a main body portion, a rotating ring configured to rotate relative to the main body portion to facilitate connection of the electromechanical joint to the downhole well tool component, and a sealed electrical connection configured to couple with a mating electrical connection of the downhole well tool component.

With the foregoing in mind, FIG. 1 is a schematic illustration of an example oil and gas well system 10. As illustrated, in certain embodiments, a coiled tubing string 12 may be run into a wellbore 14 that traverses a hydrocarbon-bearing formation 16. While certain elements of the oil and gas well system 10 are illustrated in FIG. 1, other elements of the well (e.g., blow-out preventers, wellhead "tree", etc.) have been omitted for clarity of illustration. In certain embodiments, the oil and gas well system 10 includes an interconnection of pipes, including vertical and/or horizontal casings 18, coiled tubing 20, and so forth, that connect to a surface facility 22 at the surface 24 of the oil and gas well system 10. In certain embodiments, the coiled tubing 20 extends inside the casing 18 and terminates at a tubing head (not shown) at or near the surface 24. In addition, in certain embodiments, the casing 18 contacts the wellbore 14 and terminates at a casing head (not shown) at or near the surface 24.

In certain embodiments, a bottom hole assembly ("BHA") 26 may be run inside the casing 18 by the coiled tubing 20. As illustrated, in certain embodiments, the BHA 26 may include a downhole motor 28 that operates to rotate a drill bit 30 (e.g., during drilling operations) or other downhole well tool. In certain embodiments, the downhole motor 28 may be driven by hydraulic forces carried in fluid supplied from the surface 24 of the oil and gas well system 10. In certain embodiments, the BHA 26 may be connected to the coiled tubing 20, which is used to run the BHA 26 to a desired location within the wellbore 14. It is also contemplated that, in certain embodiments, the rotary motion of the drill bit 30 may be driven by rotation of the coiled tubing 20 effectuated by a rotary table or other surface-located rotary actuator. In such embodiments, the downhole motor 28 may be omitted.

In certain embodiments, the coiled tubing 20 may also be used to deliver fluid 32 to the drill bit 30 through an interior of the coiled tubing 20 to aid in the drilling process and carry cuttings and possibly other fluid and solid components in return fluid 34 that flows up the annulus between the coiled tubing 20 and the casing 18 (or via a return flow path provided by the coiled tubing 20, in certain embodiments) for return to the surface facility 22. It is also contemplated that the return fluid 34 may include remnant proppant (e.g., sand) or possibly rock fragments that result from a hydraulic fracturing application, and flow within the oil and gas well system 10. Under certain conditions, fracturing fluid and possibly hydrocarbons (oil and/or gas), proppants and possibly rock fragments may flow from the fractured formation 16 through perforations in a newly opened interval and back to the surface 24 of the oil and gas well system 10 as part of the return fluid 34. In certain embodiments, the BHA 26 may be supplemented behind the rotary drill by an isolation device such as, for example, an inflatable packer that may be activated to isolate the zone below or above it, and enable local pressure tests.

As such, in certain embodiments, the oil and gas well system 10 may include a downhole well tool 36 that is moved along the wellbore 14 via the coiled tubing 20. In the illustrated embodiment, the downhole well tool 36 includes a drill bit 30, which may be powered by a motor 28 (e.g., a positive displacement motor (PDM), or other hydraulic motor) of a BHA 26. In certain embodiments, the wellbore 14 may be an open wellbore or a cased wellbore defined by a casing 18. In addition, in certain embodiments, the wellbore 14 may be vertical or horizontal or inclined. It should be noted the downhole well tool 36 may be part of various types of BHAs 26 coupled to the coiled tubing 20. For example, as described in greater detail herein, the BHA 26 may be configured to couple to other types of downhole well tools including, but not limited to, downhole plugs such as electrically expandable plugs.

As also illustrated in FIG. 1, in certain embodiments, the oil and gas well system 10 may include a downhole sensor package 38 having a plurality of downhole sensors 40. In certain embodiments, the sensor package 38 may be mounted along the coiled tubing string 12, although certain downhole sensors 40 may be positioned at other downhole locations in other embodiments. In certain embodiments, data from the downhole sensors 40 may be relayed uphole to a surface processing system 42 (e.g., a computer-based processing system) disposed at the surface 24 and/or other suitable location of the oil and gas well system 10. In certain embodiments, the data may be relayed uphole in substantially real time (e.g., relayed while it is detected by the downhole sensors 40 during operation of the downhole well tool 36) via a wired or wireless telemetric control line 44, and this real-time data may be referred to as edge data. In certain embodiments, the telemetric control line 44 may be in the form of an electrical line, fiber-optic line, or other suitable control line for transmitting data signals. In certain embodiments, the telemetric control line 44 may be routed along an interior of the coiled tubing 20, within a wall of the coiled tubing 20, or along an exterior of the coiled tubing 20. In addition, in certain embodiments, additional data (e.g., surface data) may be supplied by surface sensors 46 and/or stored in memory locations 48. By way of example, historical data and other useful data may be stored in a memory location 48 such as cloud storage 50.

As illustrated, in certain embodiments, the coiled tubing 20 may deployed by a coiled tubing unit 52 and delivered downhole via an injector head 54. In certain embodiments, the injector head 54 may be controlled to slack off or pick up on the coiled tubing 20 so as to control the tubing string weight and, thus, the weight on bit (WOB) acting on the downhole well tool 36. In certain embodiments, the downhole well tool 36 may be moved along the wellbore 14 via the coiled tubing 20 under control of the injector head 54 so as to apply a desired tubing weight.

In certain embodiments, fluid 32 may be delivered downhole under pressure from a pump unit 56. In certain embodiments, the fluid 32 may be delivered by the pump unit 56 through the downhole hydraulic motor 28 to power the downhole hydraulic motor 28, for example. In certain embodiments, the return fluid 34 is returned uphole, and this flow back of return fluid 34 is controlled by suitable flow back equipment 58. In certain embodiments, the flow back equipment 58 may include chokes and other components/equipment used to control flow back of the return fluid 34 in a variety of applications, including well treatment applications.

Figure 2:
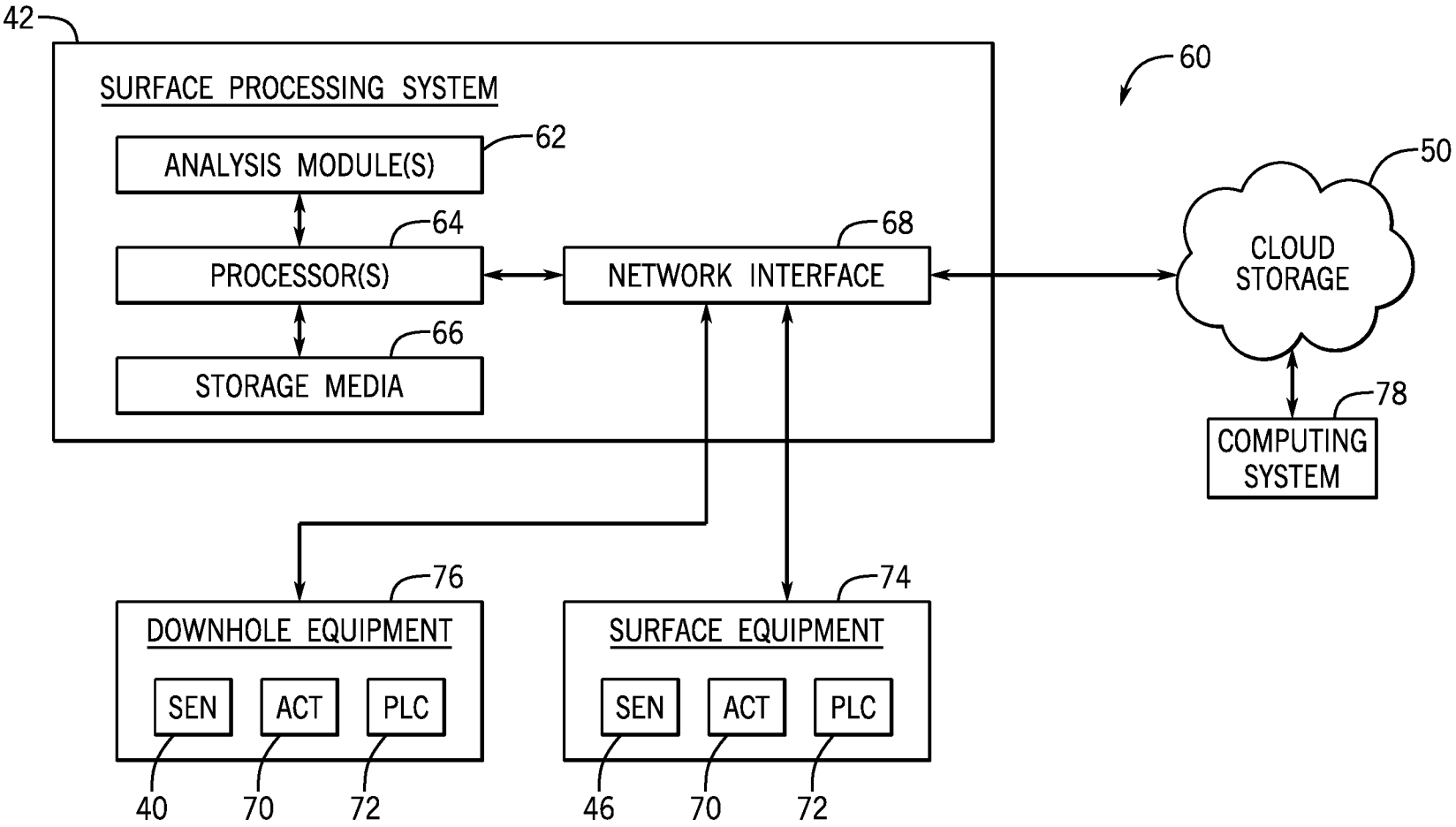
FIG. 2 illustrates a well control system that may include a surface processing system to control the oil and gas well system described herein, in accordance with embodiments of the present disclosure.

FIG. 2 illustrates a well control system 60 that may include the surface processing system 42 to control the oil and gas well system 10 described herein. In certain embodiments, the surface processing system 42 may include one or more analysis modules 62 (e.g., a program of computer-executable instructions and associated data) that may be configured to perform various functions of the embodiments described herein. In certain embodiments, to perform these various functions, an analysis module 62 executes on one or more processors 64 of the surface processing system 42, which may be connected to one or more storage media 66 of the surface processing system 42. Indeed, in certain embodiments, the one or more analysis modules 62 may be stored in the one or more storage media 66.

In certain embodiments, the one or more processors 64 may include a microprocessor, a microcontroller, a processor module or subsystem, a programmable integrated circuit, a programmable gate array, a digital signal processor (DSP), or another control or computing device. In certain embodiments, the one or more storage media 66 may be implemented as one or more non-transitory computer-readable or machine-readable storage media. In certain embodiments, the one or more storage media 66 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the computer-executable instructions and associated data of the analysis module(s) 62 may be provided on one computer-readable or machine-readable storage medium of the storage media 66, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the one or more storage media 66 may be located either in the machine running the machine-readable instructions, or may be located at a remote site from which machine-readable instructions may be downloaded over a network for execution.

In certain embodiments, the processor(s) 64 may be connected to a network interface 68 of the surface processing system 42 to allow the surface processing system 42 to communicate with the various downhole sensors 40 and surface sensors 46 described herein, as well as communicate with the actuators 70 and/or PLCs 72 of the surface equipment 74 (e.g., the coiled tubing unit 52, the pump unit 56, the flowback equipment 58, and so forth) and of the downhole equipment 76 (e.g., the BHA 26, the downhole well tool 36, and so forth) for the purpose of controlling operation of the oil and gas well system 10, as described in greater detail herein. In certain embodiments, the network interface 68 may also facilitate the surface processing system 42 to communicate data to cloud storage 50 (or other wired and/or wireless communication network) to, for example, archive the data or to enable external computing systems 78 to access the data and/or to remotely interact with the surface processing system 42.

It should be appreciated that the well control system 60 illustrated in FIG. 2 is only one example of a well control system, and that the well control system 60 may have more or fewer components than shown, may combine additional components not depicted in the embodiment of FIG. 2, and/or the well control system 60 may have a different configuration or arrangement of the components depicted in FIG. 2. In addition, the various components illustrated in FIG. 2 may be implemented in hardware, software, or a combination of both hardware and software, including one or more signal processing and/or application specific integrated circuits. Furthermore, the operations of the well control system 60 as described herein may be implemented by running one or more functional modules in an information processing apparatus such as application specific chips, such as application-specific integrated circuits (ASICs), field-programmable gate arrays (FPGAs), programmable logic devices (PLDs), systems on a chip (SOCs), or other appropriate devices. These modules, combinations of these modules, and/or their combination with hardware are all included within the scope of the embodiments described herein.

Figure 3:
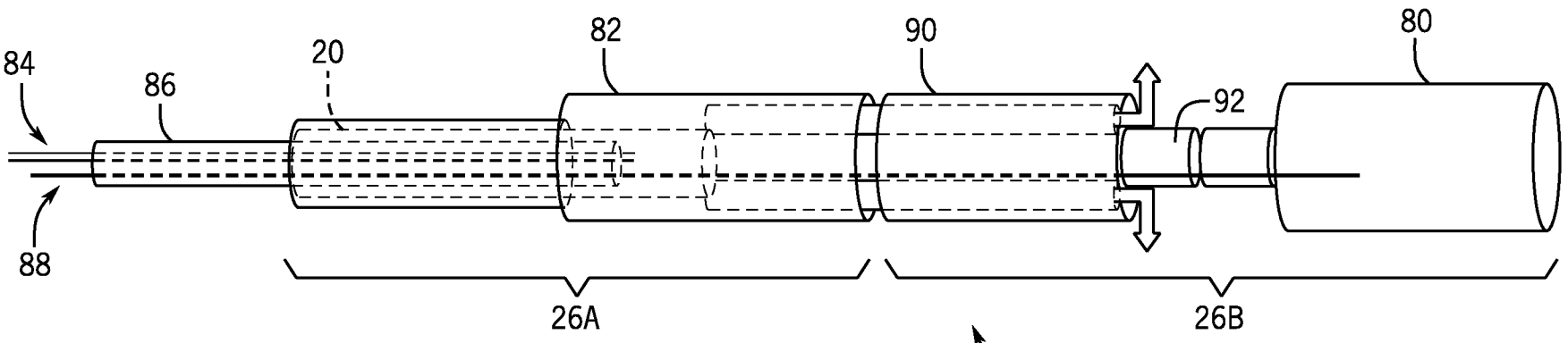
FIG. 3 illustrates a conventional BHA that includes an upper BHA and a lower BHA.

As described in greater detail herein, the BHA 26 illustrated in FIG. 1 may be configured to couple to various other downhole well tool components 80 that are disposed downhole within a wellbore 14. For example, in certain embodiments, a downhole well tool component 80 to which the BHA 26 may connect may include a downhole plug, such as an electrically expandable plug. For example, FIG. 3 illustrates a conventional BHA 26 that includes an upper BHA 26A and a lower BHA 26B. As illustrated, in certain embodiments, the upper BHA 26A may include a motor head assembly ("MHA") 82 having optical connectors configured to couple to optical lines 84 extend through coiled tubing 20 being used to convey the BHA 26 into a wellbore 14 and, in certain embodiments, a fiber optic cable 86 installed within the coiled tubing 20 to enable the BHA 26 to communicate with the surface processing system 42, as described in greater detail herein. In addition, in certain embodiments, the MHA 82 may be configured to transmit power to the downhole well tool component 80 via power lines 88 extending through the coiled tubing 20, the fiber optic cable 86, the MHA 82 and, in certain embodiments, an adapter 90 of the lower BHA 26B that couples the upper BHA 26A to the downhole well tool component 80.

In such conventional BHAs 26, the adapter 90 may include a mono conductor connection 92 at a downhole axial end of the adapter 90, which means that there is only a single radial alignment of the adapter 90 with respect to the downhole well tool component 80 that enables electrical and mechanical coupling of the adapter 90 to the downhole well tool component 80. In particular, in such embodiments, the coiled tubing 20 must twist to enable the adapter 90 to couple to the downhole well tool component 80. In certain situations, the amount of twist/rotation that the adapter 90 must undergo to engage the downhole well tool component 80 may be between 0° and about 70°. If other types of cables (e.g., wireline cables) that do not resist rotation (or barely resist rotation) were used to convey (or otherwise couple to) the downhole well tool 36, the cable may be relatively free to twist as far as it needs to in order to latch into and engage the downhole well tool component 80. As such, coupling of the adapter 90 to the downhole well tool component 80 may be relatively easily achieved when a wireline cable is used, but it may be relatively difficult to enable enough twisting when coiled tubing 20 is used, as illustrated in FIG. 3, due at least in part to the relatively high level of torsional stiffness of the coiled tubing 20.

Figure 4:
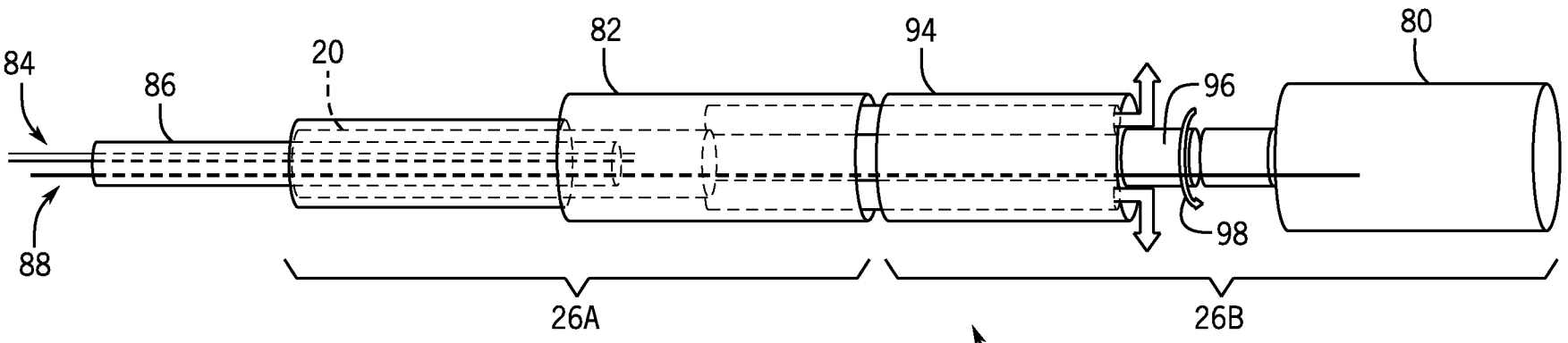
FIG. 4 illustrates a BHA having an adapter with a electromechanical joint, in accordance with embodiments of the present disclosure.

In particular, one of the problems with the adapter 90 described with respect to FIG. 3 is that the adapter 90 is not configured to rotate relative to the other components of the BHA 26. In particular, the mono conductor connection 92 of the adapter 90 illustrated in FIG. 3 is not configured to rotate relative to the rest of the adapter 90. In contrast, as illustrated in FIG. 4, the embodiments described herein provide an adapter 94 that includes a electromechanical joint 96 at a downhole axial end of the adapter 94 that facilitates easier coupling of the adapter 94 but facilitating rotation of the electromechanical joint 96 relative to the rest of the adapter 94 even when the BHA 26 is conveyed by coiled tubing 20. In particular, as described in greater detail herein, the electromechanical joint 96 includes a rotational swivel that enables the electromechanical joint 96 to easily rotate to enabling latching onto various downhole well tool components 80.

The electromechanical joint 96 described herein enables not only mechanical connection of the adapter 94 to a downhole well tool component 80, but also includes an electrical conductor that passes through the electromechanical joint 96 to enable the adapter 94 to couple both mechanically and electrically to the downhole well tool component 80. In addition, the electromechanical joint 96 described herein facilitates a connection between the adapter 94 and a downhole well tool component 80 that has only one electrical contact and one mechanical/hydraulic contact, which is relatively simple in design. As such, the embodiments described herein provide a mono conductor electromechanical swivel that is specifically designed to swivel to facilitate coupling of the adapter 94 to a downhole well tool component 80, as described in greater detail herein. Therefore, the embodiments described herein provide both mechanical and electrical integrity of a mono conductor.

Figure 5:
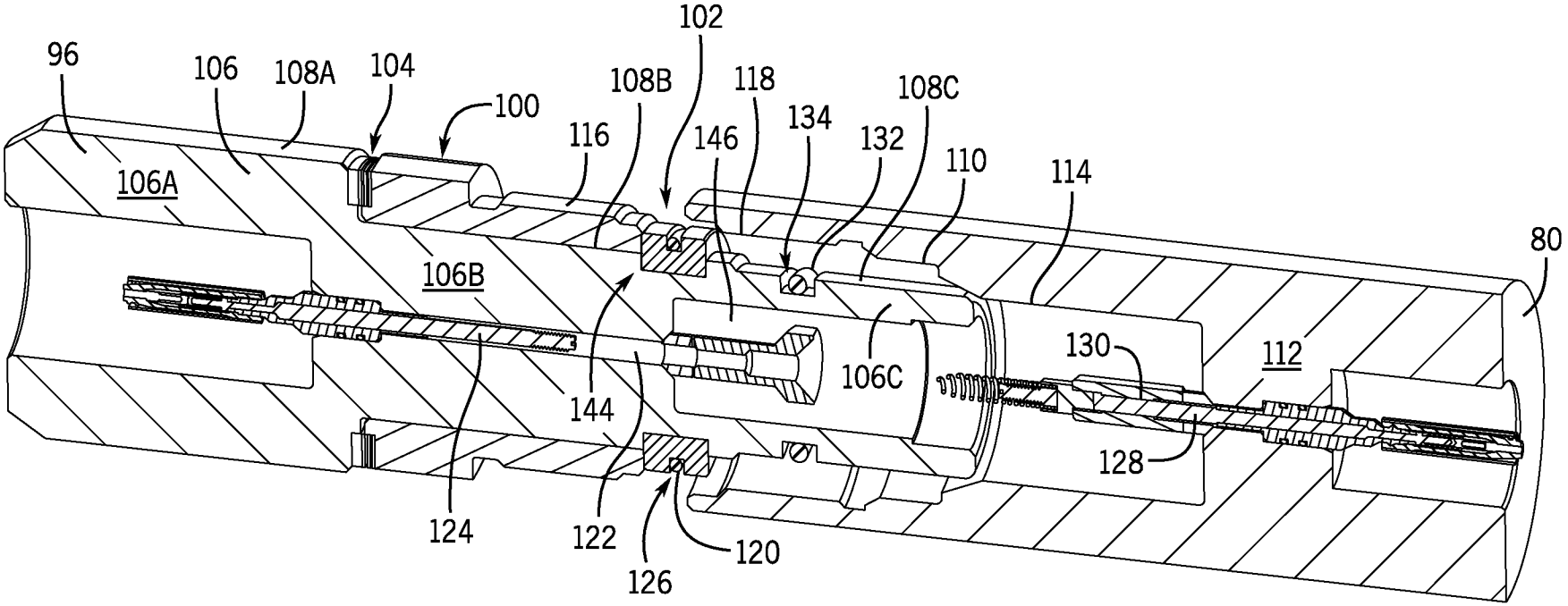
FIG. 5 is a cross-sectional perspective view of an electromechanical joint and a downhole well tool component to depict how the electromechanical joint enables the adapter to couple both electrically and mechanically using only a mono conductor, in accordance with embodiments of the present disclosure.

FIG. 5 is a cross-sectional perspective view of an electromechanical joint 96 and a downhole well tool component 80 to depict how the electromechanical joint 96 enables the electromechanical joint 96 to couple both electrically and mechanically using only a mono conductor. As illustrated in FIG. 5, in certain embodiments, the electromechanical joint 96 may include a rotating ring 100 and a split ring 102 to hold axial force (e.g., both tension and compression), which enables the electromechanical joint 96 to have both mechanical integrity and electrical integrity while also being capable of easily coupling to a downhole well tool component 80 via rotation of the electromechanical joint 96. In addition, in certain embodiments, the electromechanical joint 96 may include a bearing system 104 to reduce the friction that the electromechanical joint 96 might otherwise experience when hydrostatic pressure acts to lock the electromechanical joint 96 closed within a wellbore 14.

In addition, in certain embodiments, the electromechanical joint 96 may include a main body portion 106 that includes an upper body portion 106A, a middle body portion 106B around which the bearing system 104, the rotating ring 100, and the split ring 102 may be radially disposed, and a lower body portion 106C. An exterior surface 108A of the upper body portion 106A of the electromechanical joint 96 will not contact the downhole well tool component 80 when the electromechanical joint 96 connects to the downhole well tool component 80. However, the rotating ring 100 and a split ring 102 of the electromechanical joint 96 will directly contact a first interior surface 110 of a main body portion 112 of the downhole well tool component 80 when the electromechanical joint 96 connects to the downhole well tool component 80. Similarly, an exterior surface 108C of the lower body portion 106C of the electromechanical joint 96 will at least partially directly contact a second interior surface 114 of the main body portion 112 of the downhole well tool component 80 when the electromechanical joint 96 connects to the downhole well tool component 80.

Figure 6:
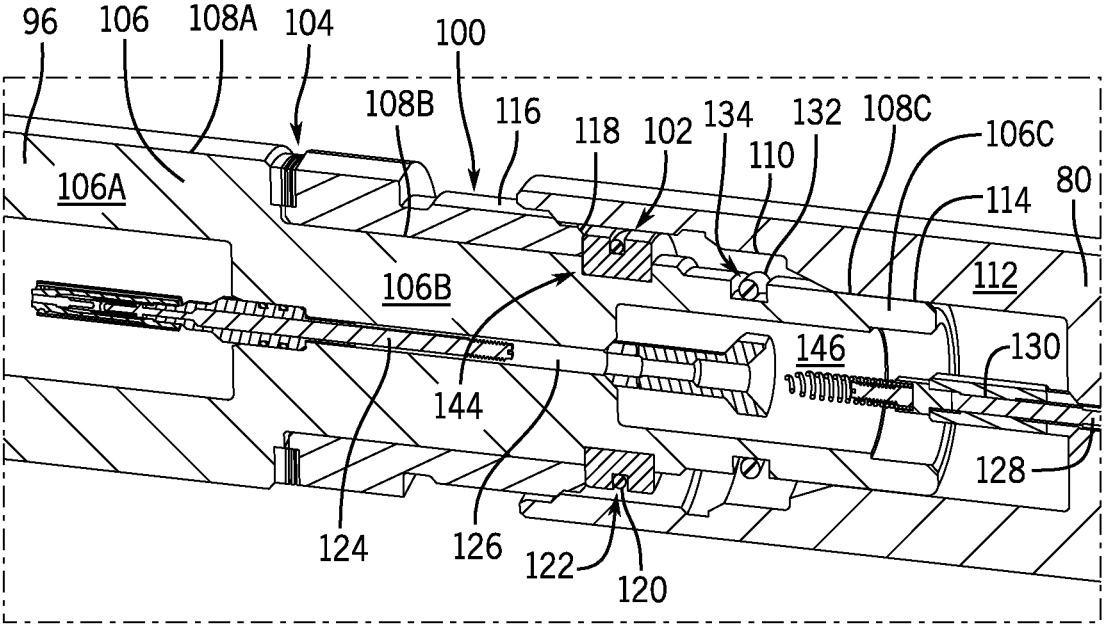
FIG. 6 is another cross-sectional perspective view of the electromechanical joint and the downhole well tool component of FIG. 5, in accordance with embodiments of the present disclosure.

FIG. 6 is another cross-sectional perspective view of the electromechanical joint 96 and the downhole well tool component 80 of FIG. 5 with the electromechanical joint 96 further inserted within the downhole well tool component 80. At this point, exterior threading 116 on the rotating ring 100 will begin engaging with mating interior threading 118 on the first interior surface 110 of the main body portion 112 of the downhole well tool component 80. As will be appreciated, the rotating ring 100 (and portions of the bearing system 104) are configured to rotate while the other components of the electromechanical joint 96 remain rotationally fixed.

Figure 7:
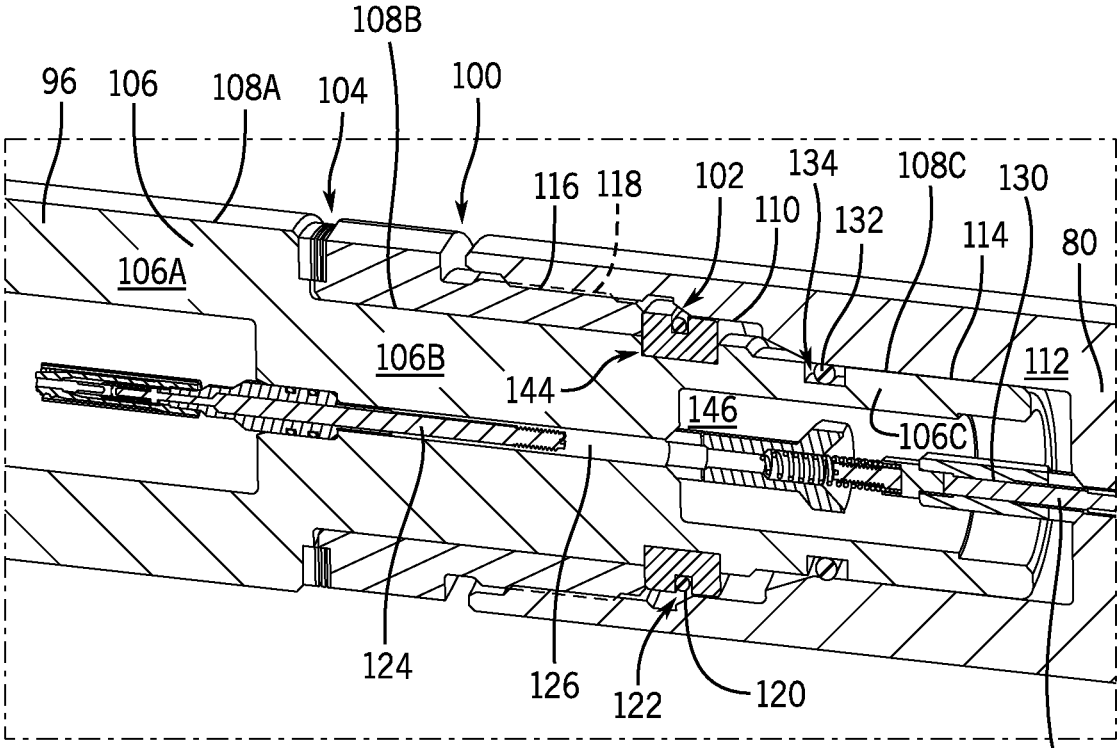
FIG. 7 is another cross-sectional perspective view of the electromechanical joint and the downhole well tool component of FIGS. 5 and 6, in accordance with embodiments of the present disclosure.

FIG. 7 is another cross-sectional perspective view of the electromechanical joint 96 and the downhole well tool component 80 of FIGS. 5 and 6 with the exterior threading 116 on the rotating ring 100 almost fully engaged with the mating interior threading 118 on the first interior surface 110 of the main body portion 112 of the downhole well tool component 80. As also illustrated, at this point, a primary sealing element (e.g., o-ring) 120 disposed within an exterior groove 122 of the split ring 102 creates a primary seal with the first interior surface 110 of the main body portion 112 of the downhole well tool component 80 to protect the electrical components (e.g., a first mono conductor electrical line 124 disposed within an interior passage 126 of the middle body portion 106B of the electromechanical joint 96 and a second mono conductor electrical line 128 disposed within an interior passage 130 of the main body portion 112 of the downhole well tool component 80) and ensure that the electrical components remain dry and in electrical contact. As also illustrated, in certain embodiments, a secondary sealing element (e.g., o-ring) 132 disposed within an exterior groove 134 of the main body portion 112 of the downhole well tool component 80 creates a secondary seal with the exterior surface 108C of the lower body portion 106C of the electromechanical joint 96 to further protect the electrical components. It will be appreciated that, once the adapter 94 and the downhole well tool component 80 are connected to each other, the mono conductor electrical lines 124, 128 may be extended from the electromechanical joint 96 and the downhole well tool component 80, respectively, such that the mono conductor electrical lines 124, 128 make contact to enable electrical coupling of the electromechanical joint 96 and the downhole well tool component 80.

Figure 8:
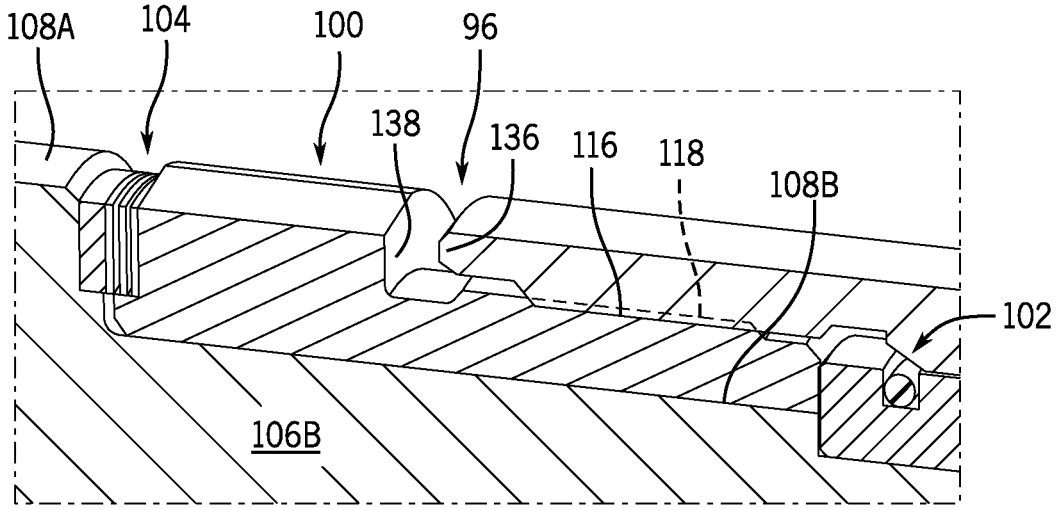
FIG. 8 is a partial cross-sectional view of the electromechanical joint in the position illustrated in FIG. 7, in accordance with embodiments of the present disclosure.

FIG. 8 is a partial cross-sectional view of the electromechanical joint 96 in the position illustrated in FIG. 7 (e.g., almost fully engaged with the downhole well tool component 80), illustrating the solid, one-piece construction of the rotating ring 100. It will be appreciated that, once the electromechanical joint 96 is fully engaged with the downhole well tool component 80 (e.g., when the exterior threading 116 on the rotating ring 100 of the electromechanical joint 96 are fully threaded with respect to the interior threading 118 on the first interior surface 110 of the main body portion 112 of the downhole well tool component 80), an upper axial end 136 of the main body portion 112 of the downhole well tool component 80 may abut a shoulder 138 of the rotating ring 100.

Figure 9:
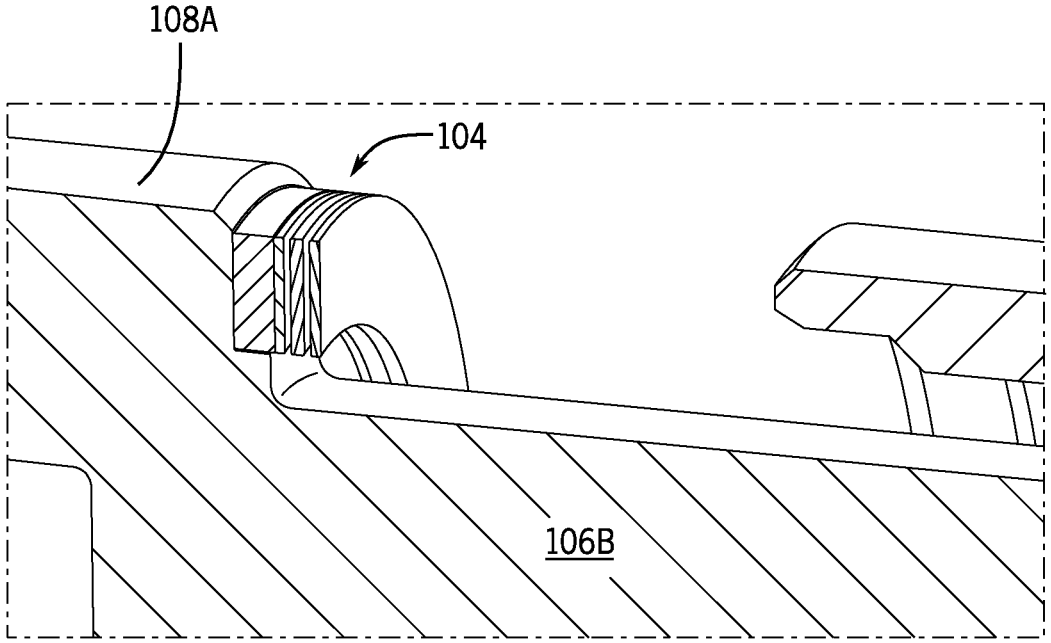
FIG. 9 is a partial cross-sectional view of the electromechanical joint, in accordance with embodiments of the present disclosure.
Figure 10:
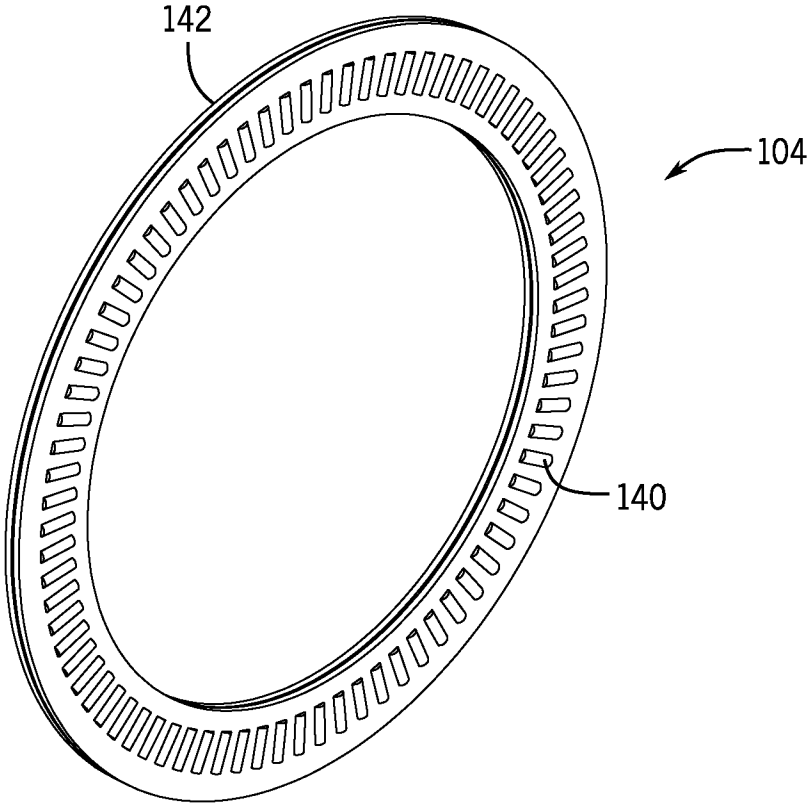
FIG. 10 is a perspective view of a bearing system of the electromechanical joint, in accordance with embodiments of the present disclosure.

FIG. 9 is a partial cross-sectional view of the electromechanical joint 96 with the rotating ring 100 removed to more fully illustrate the bearing system 104. As illustrated more clearly in FIG. 10, in certain embodiments, the bearing system 104 may be a thrust bearing that includes a roller bearing 140 and one or more washers 142 that reduce friction in the electromechanical joint 96 and enhance the ability of the electromechanical joint 96 to rotate. In particular, the bearing system 104 greatly reduces the friction that the electromechanical joint 96 would otherwise experience when hydrostatic pressure acts to lock the electromechanical joint 96 in a well. In certain embodiments, a twist point of the bearing system 104 is on the roller bearing 140 and uphole load thrust washer 142 and a secondary twist point is the bronze bearing and the uphole load thrust washer 142. The electric connection of the electromechanical joint 96 should remain sealed from the wellbore fluids. This creates a hydrostatic closing force on the electromechanical joint 96, which will create relatively high friction on shoulders of the electromechanical joint 96 that are intended to rotate. The shoulders would likely become "hydrostatically locked" unless the bearing system 104 is used to reduce the friction at the shoulders.

Figure 11:
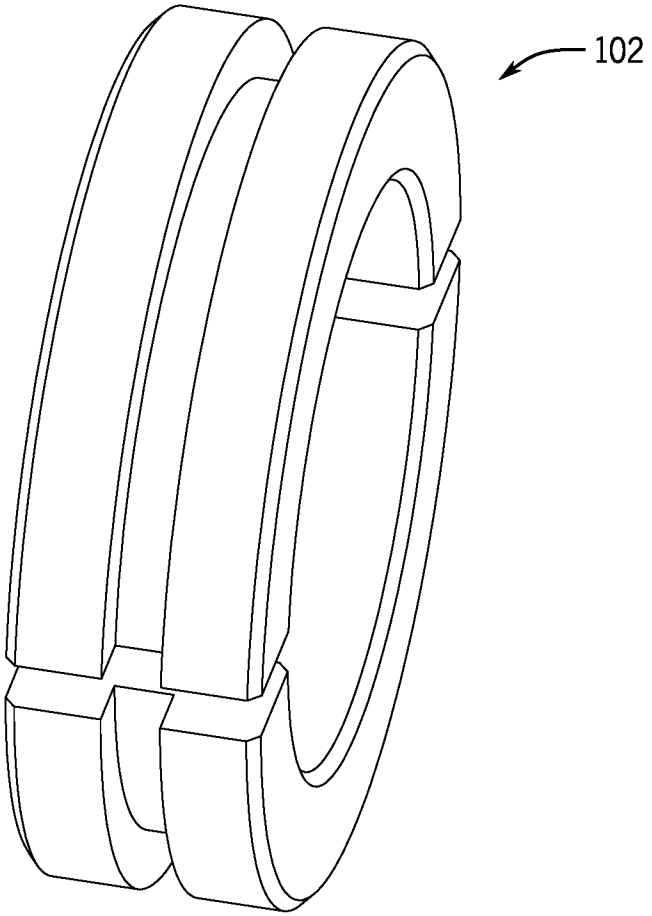
FIG. 11 is a perspective view of a split ring of the electromechanical joint, in accordance with embodiments of the present disclosure.

FIG. 11 is a perspective view of the split ring 102 of the electromechanical joint 96. As illustrated in FIGS. 5 through 7, in certain embodiments, the split ring 102 is disposed within an exterior groove 144 between the middle body portion 106B and the lower body portion 106C of the main body portion 106 of the electromechanical joint 96. In general, the split ring 102 holds the tension of the electromechanical joint 96 and, as such, is a key component of the mechanical functionality of the electromechanical joint 96. The rotating ring 100 rests against this split ring 102, which is loaded in shear as the electromechanical joint 96 is loaded in tension.

As such, the embodiments described herein include an electromechanical joint 96 that has both a mechanical connection for tension and compression (i.e., the rotating ring 100 and the split ring 102, as well as the bearing system 104), and a sealed electrical connection 124) that is free to rotate despite being surrounded by relatively high pressure fluid in a wellbore 14. In addition, the electromechanical joint 96 is not only free to rotate despite being surrounded by relatively high pressure fluid in the wellbore 14, but also has a frictional reduction system (e.g., the bearing system 104) built into it so that it can rotate freely despite the presence of relatively high friction. For example, in certain embodiments, the electromechanical joint 96 may include a bearing system 104 in the joint load pathway when the electromechanical joint 96 is operating in compression but not in tension. In addition, in certain embodiments, the electromechanical joint 96 reduces the frictional load on the shoulders of the electromechanical joint 96 by including a roller bearing 140 in the electromechanical joint 96.

In addition, the electromechanical joint 96 requires no rotation of either the upper portion of the electromechanical joint 96 (e.g., the upper body portion 106A) nor the lower portion of the electromechanical joint 96 (e.g., the lower body portion 106A) because only the solid, one-piece rotating ring 100 (and portions of the bearing system 104) are configured to rotate. In addition, the electromechanical joint 96 transfers axial tension encountered into the split ring 102, which is loaded in shear. In addition, the electromechanical joint 96 can withstand the contact force from hydrostatic pressure acting on a sealed electrical chamber 146 of the electromechanical joint 96 by ensuring that force is transferred into a low friction bearing system 104.

In particular, as described in greater detail herein, the embodiments described herein include an adapter 94 of a downhole well tool 36 that includes an electromechanical joint 96 configured to connect to a downhole well tool component 80 within a wellbore 14 of an oil and gas well system 10, wherein the electromechanical joint 96 is configured to rotate to facilitate connection of the electromechanical joint 96 to the downhole well tool component 80. In certain embodiments, the electromechanical joint 96 includes a rotating ring 100 configured to experience axial tension forces and axial compression forces acting on the electromechanical joint 96, and a sealed electrical connection 124 configured to couple with a mating electrical connection 128 of the downhole well tool component 80. In certain embodiments, the electromechanical joint 96 is configured to transfer the axial tension forces into a split ring 102 of the electromechanical joint 96, which is loaded in shear. In addition, in certain embodiments, the rotating ring 100 includes exterior threading 116 configured to engage mating interior threading 118 of the downhole well tool component 80. In addition, in certain embodiments, the rotating ring 100 is a solid, one-piece threaded ring.

In addition, in certain embodiments, the electromechanical joint 96 includes a frictional reduction system configured to reduce friction between the rotating ring 100 and a main body portion 106 of the electromechanical joint 96. In certain embodiments, the frictional reduction system includes a bearing system 104 disposed axially between the rotating ring 100 and the main body portion 106 of the electromechanical joint 96. In addition, in certain embodiments, the bearing system 104 includes a roller bearing 140 configured to reduce a frictional load on shoulders of the electromechanical joint 96. In addition, in certain embodiments, the rotating ring 100 and a portion of the bearing system 104 (e.g., rollers of the roller bearing 140) are the only components of the electromechanical joint 96 configured to rotate (e.g., relative to the main body portion 106 of the electromechanical joint 96). In addition, in certain embodiments, the electromechanical joint 96 includes a plurality of sealing elements 120, 132 configured to protect a sealed electrical chamber 146 of the electromechanical joint 96 from hydrostatic pressure external to the electromechanical joint 96.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. A downhole well tool adapter, comprising:

an electromechanical joint configured to connect to a downhole well tool component within a wellbore of an oil and gas well system, wherein the electromechanical joint comprises:

a main body portion;

a rotating ring disposed radially around the main body portion and configured to rotate relative to the main body portion to facilitate transition to a single radial alignment of the electromechanical joint with the downhole well tool component, wherein the rotating ring is configured to directly contact an interior surface of the downhole well tool component when the electromechanical joint connects to the downhole well tool component;

a split ring disposed within a first exterior groove of the main body portion, wherein the split ring is configured to directly contact the interior surface of the downhole well tool component when the electromechanical joint connects to the downhole well tool component;

a frictional reduction system configured to reduce friction between the rotating ring and the main body portion, wherein the rotating ring and a portion of the frictional reduction system are the only components of the electromechanical joint configured to rotate relative to the main body portion;

a plurality of sealing elements comprising a primary sealing element disposed within an exterior groove of the split ring, and a secondary sealing element disposed within a second exterior groove of the main body portion; and a sealed mono conductor electrical connection disposed within an interior passage extending axially through the main body portion, wherein the sealed mono conductor electrical connection is configured to couple with a mating mono conductor electrical connection of the downhole well tool component.

2. The downhole well tool adapter of claim 1, wherein the rotating ring is configured to experience axial tension forces and axial compression forces acting on the electromechanical joint.

3. The downhole well tool adapter of claim 2, wherein the electromechanical joint is configured to transfer the axial tension forces into the split ring of the electromechanical joint that is loaded in shear.

4. The downhole well tool adapter of claim 2, wherein the rotating ring comprises exterior threading configured to engage mating interior threading of the downhole well tool component.

5. The downhole well tool adapter of claim 2, wherein the rotating ring is a solid, one-piece threaded ring configured to abut only the main body portion, the split ring, and the frictional reduction system of the electromechanical joint.

6. The downhole well tool adapter of claim 1, wherein the frictional reduction system comprises a bearing system disposed axially between the rotating ring and the main body portion of the electromechanical joint.

7. The downhole well tool adapter of claim 6, wherein the bearing system comprises a roller bearing configured to reduce a frictional load on shoulders of the electromechanical joint.

8. The downhole well tool adapter of claim 3, wherein the plurality of sealing elements are configured to protect a sealed electrical chamber of the electromechanical joint from hydrostatic pressure external to the electromechanical joint.

9. An electromechanical joint, comprising:

a main body portion;

a rotating ring disposed radially around the main body portion and configured to rotate relative to the main body portion to facilitate connection of the electromechanical joint to a downhole well tool component within a wellbore of an oil and gas well system, wherein the rotating ring is configured to directly contact an interior surface of the downhole well tool component when the electromechanical joint connects to the downhole well tool component;

a split ring disposed within a first exterior groove of the main body portion, wherein the split ring is configured to directly contact the interior surface of the downhole well tool component when the electromechanical joint connects to the downhole well tool component;

a frictional reduction system configured to reduce friction between the rotating ring and the main body portion, wherein the rotating ring and a portion of the frictional reduction system are the only components of the electromechanical joint configured to rotate relative to the main body portion;

a plurality of sealing elements comprising a primary sealing element disposed within an exterior groove of the split ring, and a secondary sealing element disposed within a second exterior groove of the main body portion; and a sealed mono conductor electrical connection disposed within an interior passage extending axially through the main body portion, wherein the sealed mono conductor electrical connection is configured to couple with a mating mono conductor electrical connection of the downhole well tool component; wherein rotation of the rotating ring relative to the main body portion facilitates transition to a single radial alignment of the electromechanical joint with the downhole well tool component.

10. The electromechanical joint of claim 9, wherein the rotating ring is configured to experience axial tension forces and axial compression forces acting on the electromechanical joint.

11. The electromechanical joint of claim 10, wherein the electromechanical joint is configured to transfer the axial tension forces into the split ring of the electromechanical joint that is loaded in shear.

12. The electromechanical joint of claim 9, wherein the rotating ring comprises exterior threading configured to engage mating interior threading of the downhole well tool component.

13. The electromechanical joint of claim 11, wherein the rotating ring is a solid, one-piece threaded ring configured to abut only the main body portion, the split ring, and the frictional reduction system of the electromechanical joint.

14. The electromechanical joint of claim 9, wherein the frictional reduction system comprises a bearing system disposed axially between the rotating ring and the main body portion.

15. The electromechanical joint of claim 14, wherein the bearing system comprises a roller bearing configured to reduce a frictional load on shoulders of the electromechanical joint.

16. The electromechanical joint of claim 11, wherein the plurality of sealing elements are configured to protect a sealed electrical chamber of the electromechanical joint from hydrostatic pressure external to the electromechanical joint.

* * * * *